US008286388B2

(12) United States Patent
Zhao et al.

(10) Patent No.: US 8,286,388 B2
(45) Date of Patent: Oct. 16, 2012

(54) JALOUSIE WINDOW

(75) Inventors: David Dezhou Zhao, Tacoma, WA (US); Kevin Dwayne Vilhauer, Puyallup, WA (US)

(73) Assignee: Milgard Manufacturing Inc., Tacoma, WA (US)

( * ) Notice: Subject to any disclaimer, the term of this patent is extended or adjusted under 35 U.S.C. 154(b) by 604 days.

(21) Appl. No.: 11/880,064

(22) Filed: Jul. 19, 2007

(65) Prior Publication Data

US 2009/0019774 A1 Jan. 22, 2009

(51) Int. Cl.
*E06B 7/08* (2006.01)

(52) U.S. Cl. ..... 49/74.1; 49/504; 49/91.1

(58) Field of Classification Search ..... 49/74.1, 49/91.1, 87.1, 403, 504; 52/473
See application file for complete search history.

(56) References Cited

U.S. PATENT DOCUMENTS

| | | | | |
|---|---|---|---|---|
| 2,654,921 | A | 10/1953 | Blanchard | |
| 2,813,314 | A | 11/1957 | Landry | |
| 2,867,304 | A | 1/1959 | Greene | |
| 3,041,678 | A | 7/1962 | Copp, Jr. | |
| 4,813,183 | A | 3/1989 | Jordal | |
| 5,524,390 | A | 6/1996 | Christensen | |
| 5,560,147 | A * | 10/1996 | Ashida et al. | 49/74.1 |
| 5,603,585 | A * | 2/1997 | Bruchu et al. | 403/382 |
| 5,687,519 | A * | 11/1997 | Bruchu | 52/213 |
| 5,906,083 | A * | 5/1999 | Olsen et al. | 52/473 |
| 6,098,339 | A | 8/2000 | Rivera et al. | |
| 6,263,632 | B1 * | 7/2001 | Cadorette | 52/473 |
| 6,276,099 | B1 | 8/2001 | O'Shea | |
| 6,318,036 | B1 * | 11/2001 | Siudzinski et al. | 52/207 |
| 6,330,769 | B1 * | 12/2001 | Manzella et al. | 52/204.62 |
| 6,789,359 | B2 * | 9/2004 | Bauman et al. | 49/471 |
| 7,246,466 | B2 * | 7/2007 | Turner | 49/504 |
| 2003/0005644 | A1 * | 1/2003 | Reithmeyer et al. | 49/467 |
| 2006/0248801 | A1 * | 11/2006 | Marocco | 49/74.1 |

* cited by examiner

*Primary Examiner* — Katherine W Mitchell
*Assistant Examiner* — Catherine A Kelly
(74) *Attorney, Agent, or Firm* — Reising Ethington PC

(57) ABSTRACT

A jalousie window in accordance with an exemplary embodiment of the present disclosure includes a jalousie window insert having parallel side rails and a plurality of window louvers extending between the side rails for simultaneous rotation around parallel horizontal axes. A window frame includes a frame head, a frame sill, and a pair of spaced frame jambs interconnected with the frame head and sill in a rectangular frame geometry. A pair of opposed jamb adapters include outer portions secured by snap fit to the frame jambs and inner portions that receive by snap fit an associated one of the insert side rails such that the side rails and the jalousie window insert are secured by the jamb adapters within the window frame. A head adapter has an outer portion secured by snap fit to the frame head, and a sill adapter has an outer portion secured by snap fit to the frame sill. Weather seals are disposed on the head and sill adapters for engagement by upper and lower louvers of the window insert in closed positions of the louvers.

13 Claims, 5 Drawing Sheets

JALOUSIE WINDOW

The present disclosure relates to a jalousie window that includes a jalousie window insert mounted by adapters within a window frame without use of fasteners or the like.

BACKGROUND AND SUMMARY OF THE DISCLOSURE

The present disclosure embodies a number of aspects that can be implemented separately from or in combination with each other.

A jalousie window in accordance with an exemplary embodiment of the present disclosure includes a jalousie window insert having parallel side rails and a plurality of window louvers extending between the side rails for simultaneous rotation around parallel horizontal axes. A window frame includes a frame head, a frame sill, and a pair of spaced frame jambs interconnected with the frame head and sill in a rectangular frame geometry. A pair of opposed jamb adapters include outer portions secured by snap fit to the frame jambs and inner portions that receive by snap fit an associated one of the insert side rails such that the side rails and the jalousie window insert are secured by the jamb adapters within the window frame. A head adapter has an outer portion secured by snap fit to the frame head, and a sill adapter has an outer portion secured by snap fit to the frame sill. Weather seals are disposed on the head and sill adapters for engagement by upper and lower louvers of the window insert in closed positions of the louvers.

The jamb adapters, the sill adapter and the head adapter preferably are of extruded plastic or aluminum construction. The head and sill adapters preferably are identical, and the jamb adapters preferably are identical and mirror images of each other. The sill adapter preferably has an open water channel beneath a lower one of the louvers that drains into at least one aligned opening beneath one jalousie window insert side rail.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
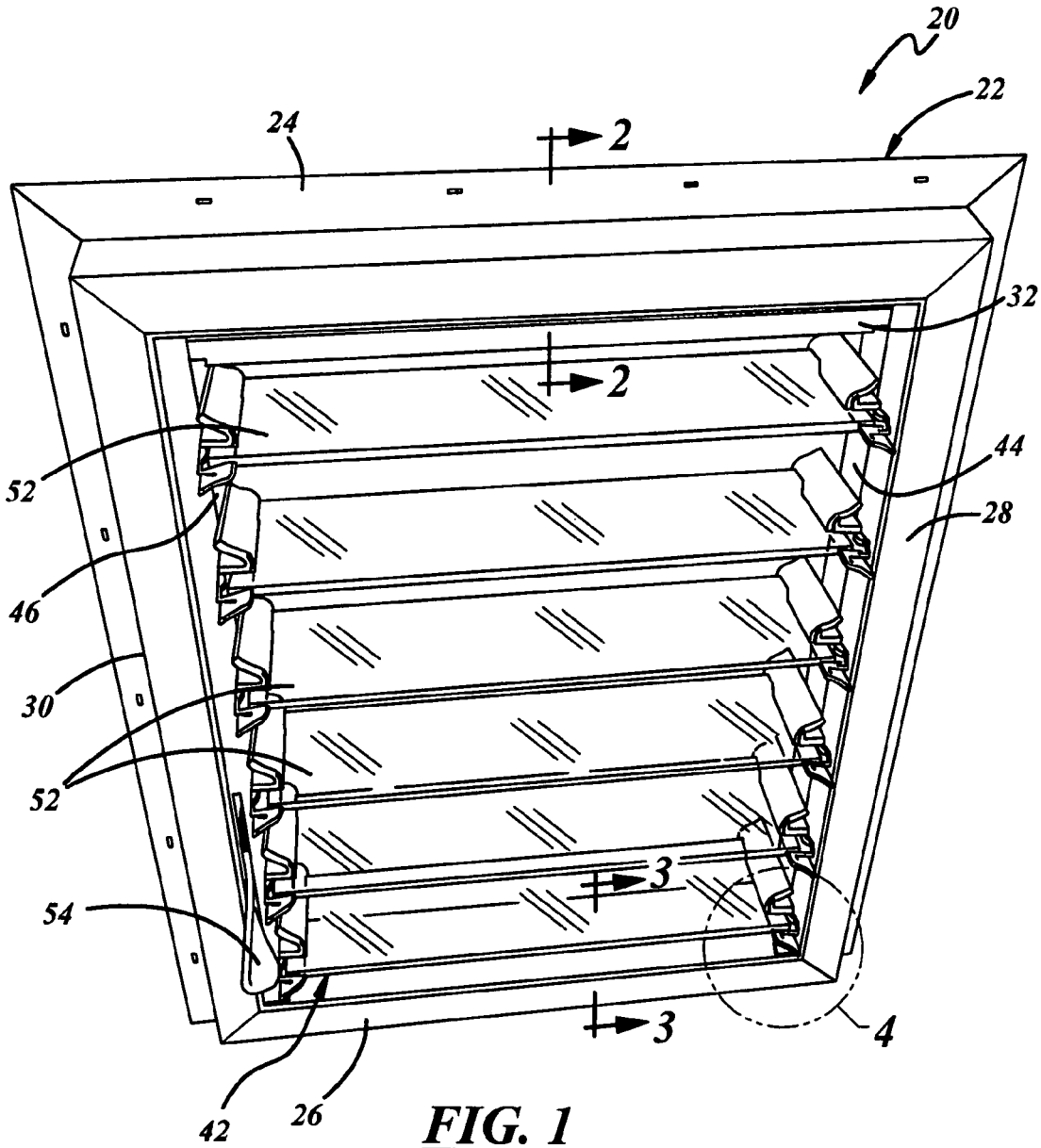
FIG. 1 is a perspective view of a jalousie window in accordance with an exemplary embodiment of the present disclosure.

FIG. 1 illustrates a jalousie window 20 in accordance with an exemplary embodiment of the present disclosure. Window 20 includes a window frame 22 with a frame head 24, a frame sill 26, and a pair of laterally spaced frame jambs 28,30 interconnected in a rectangular frame geometry. Frame head

Figure 2:
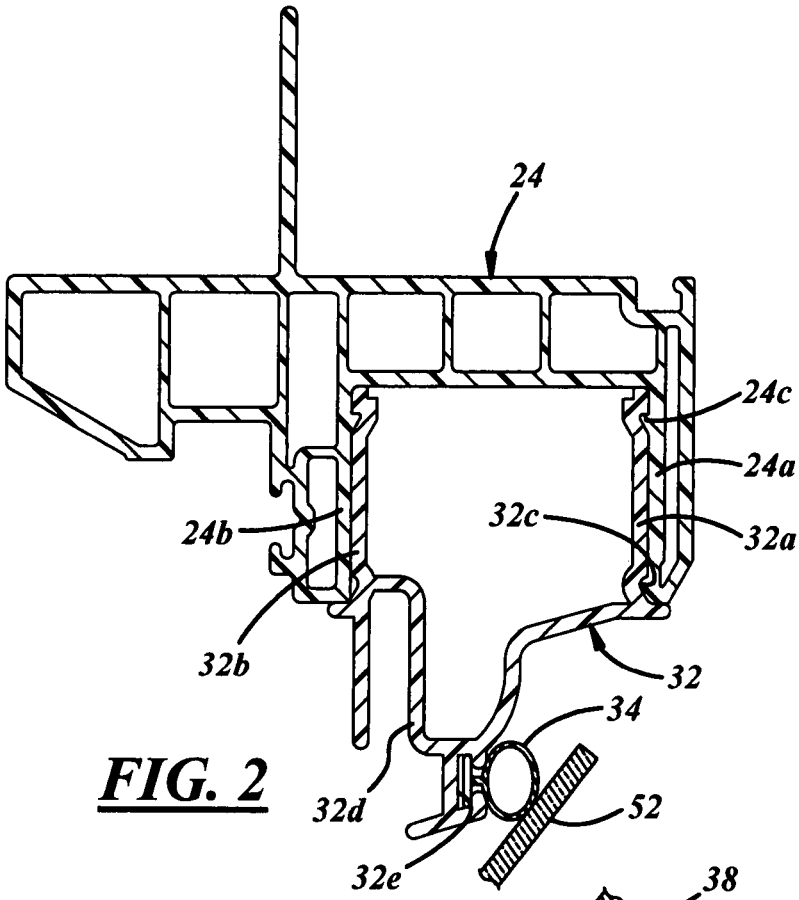
FIGS. 2 and 3 are fragmentary sectional views taken substantially along the respective lines 2-2 and 3-3 in FIG. 1.
Figure 3:
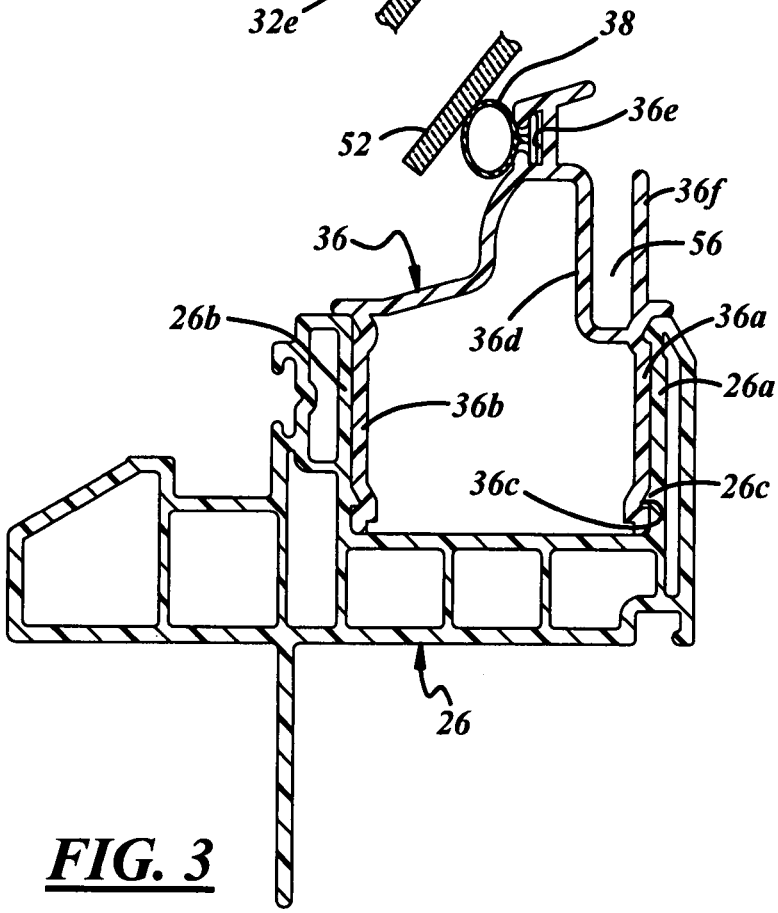
Figure 6:
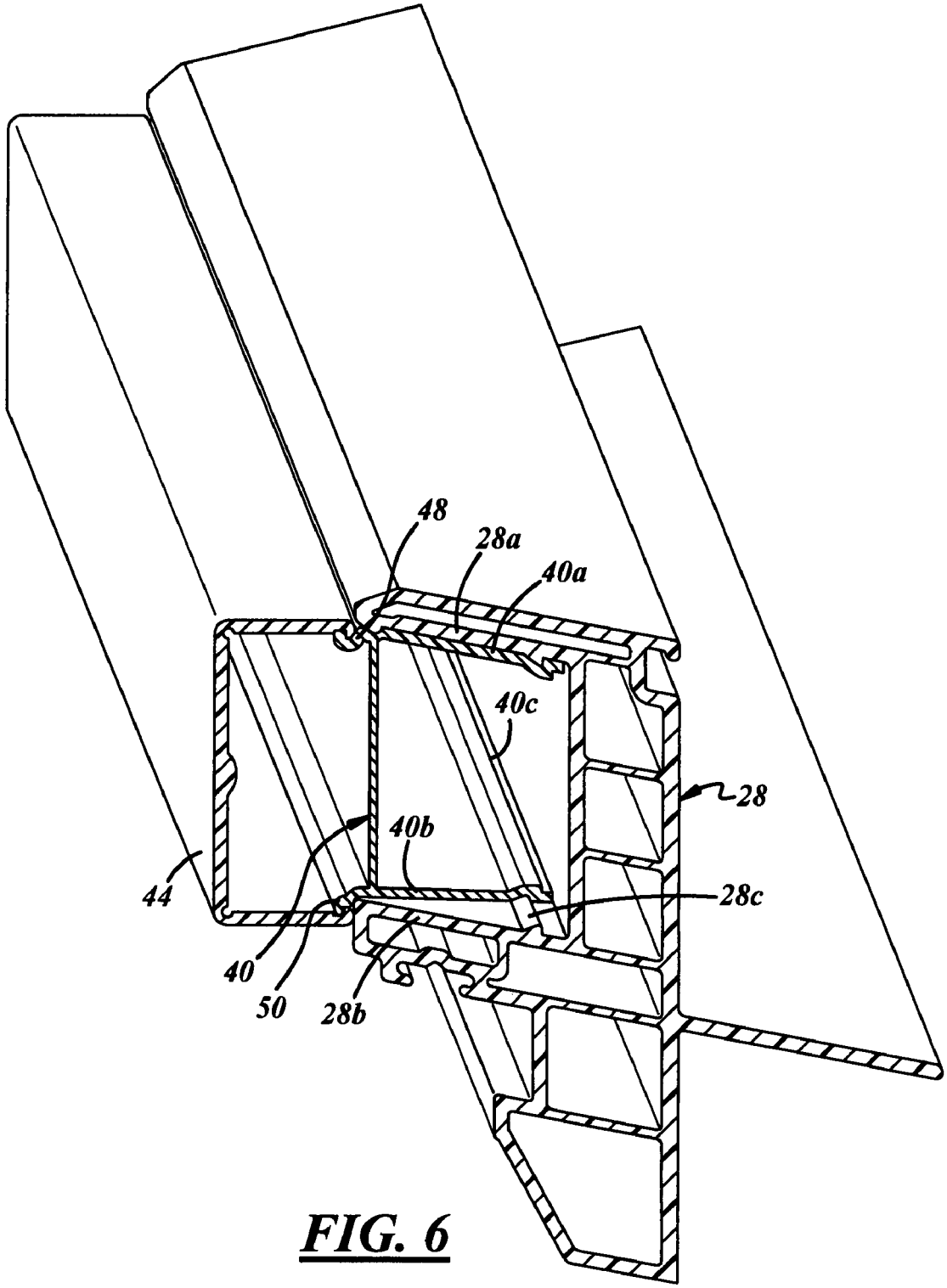
FIGS. 6 and 7 are sectional views taken substantially along the respective lines 6-6 and 7-7 in FIG. 5.

24, sill 26 and jambs 28,30 can be of any suitable cross sectional geometry for mounting window 20 on a building wall, with the geometries illustrated in the drawings being exemplary only. Frame head 24 has an inwardly opening U-shaped cross section defined in part by a pair of opposed walls 24*a*,24*b* (FIG. 2). Likewise, frame sill 26 has an inwardly opening U-shaped cross section defined in part by a pair of opposed walls 26*a*,26*b* (FIG. 3). Frame jamb 28 has an inwardly opening U-shaped cross section defined in part by a pair of opposed walls 28*a*,28*b* (FIG. 6). Frame jamb 30 is a mirror image of frame jamb 28. Frame head 24, sill 26 and jambs 28,30 can be of any suitable plastic or metal construction.

A head adapter 32 has an outer portion secured by snap fit to the inner edge of frame head 24. (Directional adjectives such as "inner" and "outer" are taken with reference to the center of window 20.) Head adapter 32 has a generally U-shaped cross section with legs 32*a*,32*b* (FIG. 2) respectively received by snap fit within walls 24*a*,24*b* of frame head 24. Barbs or beads 24*c* can be received within associated channels 32*c* to retain head adapter 32 in place. Head adapter 32 has an inwardly extending arm 32*d* with a laterally opening channel 32*e* that receives a weather seal 34. A sill adapter 36, which preferably is identical to head adapter 32, has a pair of legs 36*a*,36*b* that are received by snap fit within walls 26*a*,26*b* of frame sill 26. Again, sill adapter 36 preferably is received by snap fit within sill 26 and retained by suitable barbs or beads 26*c* being received within corresponding channels 36*c* of sill adapter 36. A leg 36*d* of sill adapter 36 extends inwardly and has a laterally opening channel 36*e* that receives a weather seal 38. It will be noted in FIGS. 2 and 3 that legs 32*d*, 36*d* are such that weather seal 34 faces the interior of the building to which window 20 is assembled while weather seal 38 faces the exterior.

Frame jambs 28,30 have opposed inwardly opening U-shaped cross-sections that each receive a jamb adapter 40 (FIG. 6). Jamb adapters 40 associated with frame jambs 28,30 are identical and mirror images of each other, with the jamb adapter associated with frame jamb 28 being shown in detail in FIG. 6. Jamb adapter 40 is of generally U-shaped cross section with opposed legs 40*a*,40*b* that are received within walls 28*a*,28*b* of frame jamb 28 and secured by snap fit, such as by barbs or beads 28*c* being received within channels 40*c*. Head adapter 32, sill adapter 36 and jamb adapters 40 preferably are of extruded plastic or aluminum construction.

Figure 4:
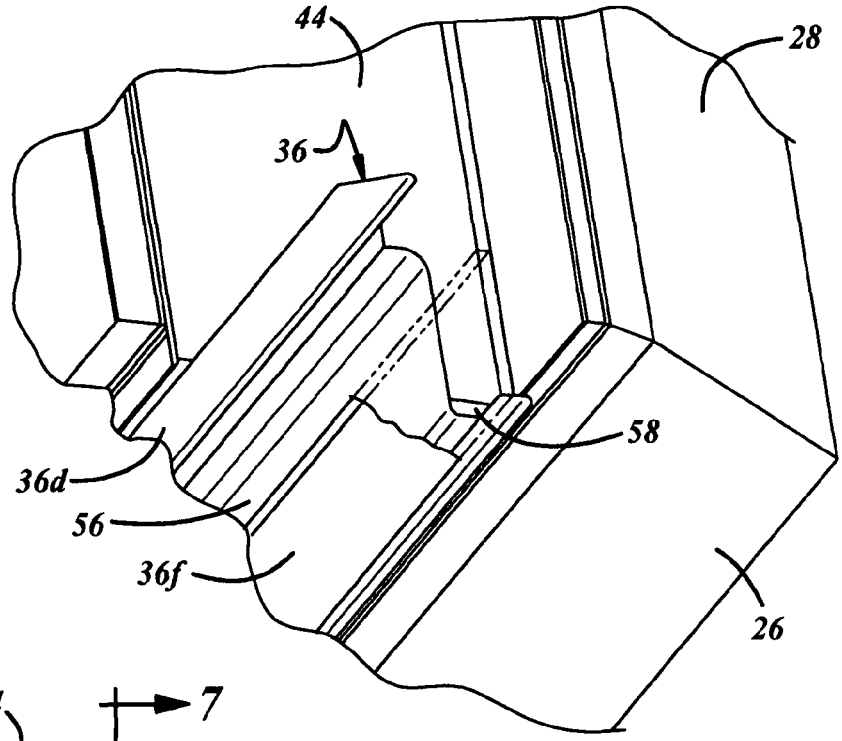
FIG. 4 is an enlarged view of the portion of FIG. 1 within the area 4.
Figure 5:
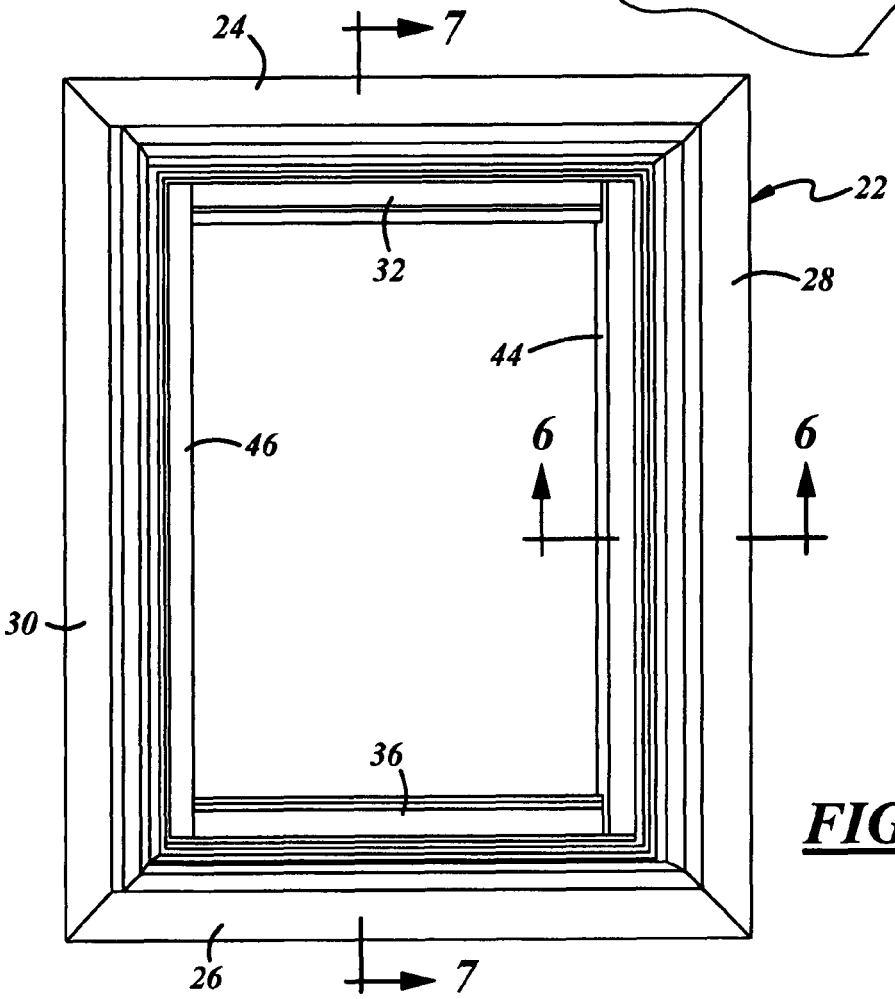
FIG. 5 is an elevational view of the window of FIG. 1 with the louvers removed for clarity.
Figure 7:
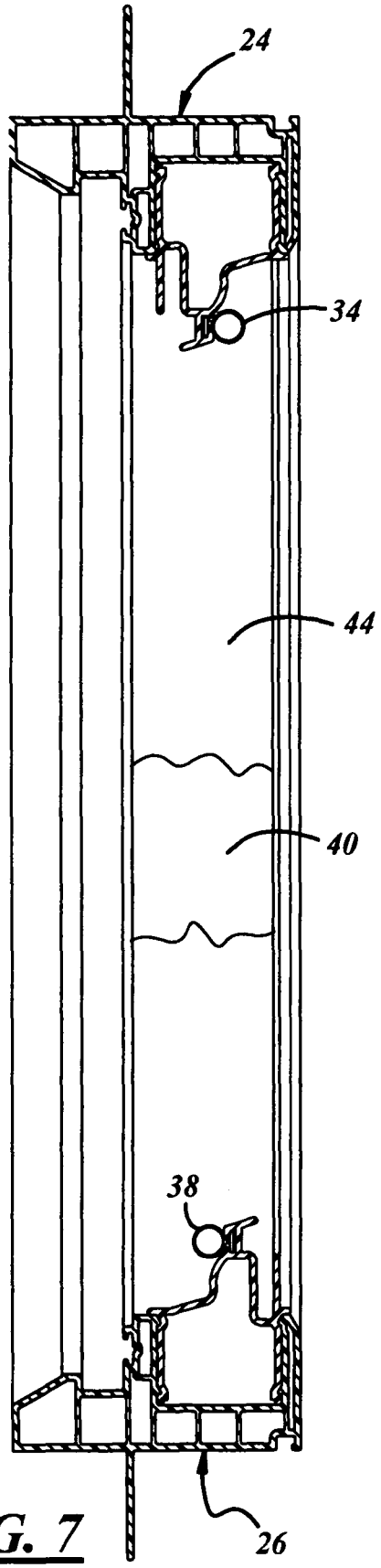
Figure 8:
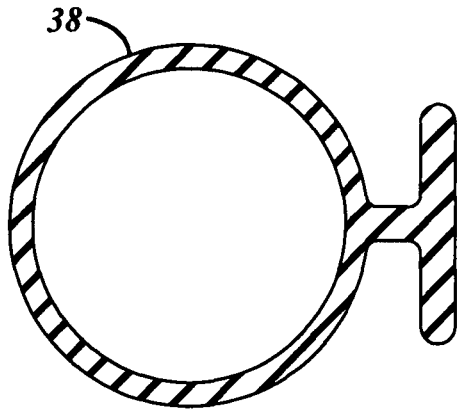
FIGS. 8 and 9 are sectional views that illustrate exemplary weather seals.
Figure 9:
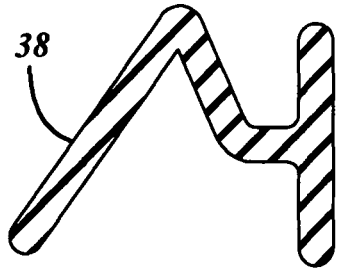

A jalousie window insert 42 has parallel side rails 44,46 that are respectively received by snap fit over inwardly extending legs 48,50 (FIG. 6) on the opposed jamb adapters 40 to secure jalousie window insert 42 in place within frame 22. Window insert 42 preferably also includes a plurality of spaced window louvers 52 that extend between side rails 44,46 for simultaneous rotation around parallel horizontal axes. Louvers 52 can be rotated by a handle 54 as illustrated in FIG. 1, or by suitable cranks or levers. Window insert 42 typically is purchased as a subassembly from a supplier, and the internal details of the insert are not part of the present disclosure. In the closed positions of louvers 52, the upper louver contacts and compresses weather seal 34 on head adapter 32 (FIG. 2) while the lower louver 52 engages and compresses weather seal 38 on sill adapter 36. Weather seals 34,38 can be of any suitable resilient construction, with two exemplary constructions being illustrated in FIGS. 8 and 9. It also will be noted in FIGS. 4-5 and 7 that, whereas head and sill adapters 32,36 are visible within frame 22, jamb adapters 40 preferably are concealed beneath jalousie window insert side rails 44.

Sill adapter 36 preferably includes a longitudinally extending flange or wall 36*f* (FIGS. 3 and 4) that forms a water channel 56 adjacent to and beneath the interior side of the lowest louver 52. Water channel 56 communicates with an opening 58 beneath the lower edge of jalousie window insert side rail 44 so that any water collected in channel 56 can drain through opening 58 and thence through appropriate weep openings to the exterior of the building. There preferably are openings 58 at both ends of sill adapter 36.

There thus has been disclosed a jalousie window that includes a jalousie window insert mounted by adapters within a window frame. The disclosure has been presented in conjunction with an exemplary embodiment, and modifications and variations have been discussed. Other modifications and variations readily will suggest themselves to persons of ordinary skill in the art in view of the foregoing description. The disclosure is intended to embrace all such modifications and variations as fall within the spirit and broad scope of the appended claims.

The invention claimed is:

1. A jalousie window that includes:

a jalousie window insert having parallel side rails and a plurality of window louvers extending between said side rails for simultaneous rotation around parallel horizontal axes, a window frame including a frame head, a frame sill, and a pair of spaced frame jambs interconnected with said frame head and said frame sill in a rectangular frame geometry, a pair of opposed jamb adapters, each of which includes an outer portion secured to an associated one of said frame jambs and an inner portion that receives one of said side rails such that said side rails and said jalousie window insert are secured by said jamb adapters within said window frame, a head adapter having an outer portion secured to said frame head, a sill adapter having an outer portion secured to said frame sill and an open water channel beneath an interior side of a lowest one of said louvers, and weather seals on said head and sill adapters for engagement by upper and lower louvers of said jalousie window insert in closed positions of said louvers, at least one of said side rails having a continuously planar lower edge spaced from said sill adapter to form an opening wherein said water channel communicates with said opening beneath said lower edge of said side rail to drain water from within said water channel and wherein said lower edge is spaced above a lower surface of said water channel to form said opening, said window frame being adapted to mount said window on a building wall such that one side of said window is on an interior side of said wall, and wherein said open water channel is on said one side of said window.

2. The window set forth in claim 1 wherein said jamb adapters, said head adapter and said sill adapter are of extruded plastic or aluminum construction.

3. The window set forth in claim 2 wherein said frame head, said frame sill and said frame jambs have inwardly opening U-shaped channels, and wherein said outer portions of said head adapter, said sill adapter and said jamb adapters are of U-shaped cross section with opposed legs that are received by snap fit within said U-shaped channels.

4. The window set forth in claim 3 wherein said head and sill adapters have inner portions with channels in which said weather seals are disposed.

5. The window set forth in claim 4 wherein said inner portions of said jamb adapters have legs that receive outer edges of said rails.

6. The window set forth in claim 2 wherein said head and sill adapters are identical.

7. The window set forth in claim 6 wherein said jamb adapters are mirror images of each other.

8. A jalousie window that includes:

a jalousie window insert having parallel side rails and a plurality of window louvers extending between said side rails for simultaneous rotation around parallel horizontal axes, a window frame including a frame head, a frame sill, and a pair of spaced frame jambs interconnected with said frame head and said frame sill in a rectangular frame geometry, a pair of opposed jamb adapters including outer portions respectively secured to said frame jambs and inner portions that respectively receive said side rails to secure said jalousie window insert within said window frame, a head adapter having an outer portion secured to said frame head, a sill adapter having an outer portion secured to said frame sill and a wall that forms a water channel adjacent to and beneath an interior side of the lowest of said louvers, weather seals on said head and sill adapters for engagement by an upper louver and said lowest louver of said jalousie window insert in closed positions of said louvers, and at least one of said side rails having a continuously planar lower edge spaced from said sill adapter to form at least one opening that communicates with said water channel to drain water from within said water channel wherein said water channel communicates with said opening beneath said lower edge of said side rail.

9. The window set forth in claim 8 wherein said head and sill adapters have inner portions with channels in which said weather seals are disposed.

10. The window set forth in claim 8 wherein said inner portions of said pair of opposed jamb adapters have legs that receive outer edges of said side rails by snap fit so that said side rails conceal said jamb adapters and to secure said jalousie window insert within said window frame.

11. The window set forth in claim 8 wherein said jamb adapters are mirror images of one another, said head adapter and said sill adapter are identical, and all of said adapters are of extruded plastic or aluminum construction, and wherein said frame head, said frame sill and said frame jambs have inwardly opening U-shaped channels, and wherein said outer portions of said head adapter, said sill adapter and said jamb adapters are of U-shaped cross section with opposed legs that are received by snap fit within said U-shaped channels.

12. The window set forth in claim 1 wherein said outer portions of said jamb adapters, are secured by snap fit to said frame jambs and said inner portions of said jamb adapters receive by snap fit said side rails.

13. The window set forth in claim 1 wherein said outer portion of said head adapter is secured by snap fit to said frame head, and said outer portion of said sill adapter is secured by snap fit to said frame sill.

* * * * *